US009617704B2

(12) United States Patent
Kent

(10) Patent No.: US 9,617,704 B2
(45) Date of Patent: Apr. 11, 2017

(54) REINFORCEMENT ASSEMBLIES, FIXTURES, AND METHODS

(71) Applicant: Jereme Kent, Findlay, OH (US)

(72) Inventor: Jereme Kent, Findlay, OH (US)

(73) Assignee: ONE ENERGY ENTERPRISES LLC, Findlay, OH (US)

( * ) Notice: Subject to any disclaimer, the term of this patent is extended or adjusted under 35 U.S.C. 154(b) by 0 days.

(21) Appl. No.: 14/721,070

(22) Filed: May 26, 2015

(65) Prior Publication Data

US 2015/0345101 A1 Dec. 3, 2015

Related U.S. Application Data

(60) Provisional application No. 61/997,279, filed on May 27, 2014.

(51) Int. Cl.
*E02D 5/74* (2006.01)
*E02D 5/76* (2006.01)
(Continued)

(52) U.S. Cl.
CPC ..... *E02D 27/08* (2013.01); *E02D 27/425* (2013.01); *E04C 5/0645* (2013.01); *E04C 5/166* (2013.01); *E02D 5/74* (2013.01); *E02D 2200/1621* (2013.01); *E04B 2103/06* (2013.01); *E04H 12/08* (2013.01); *E04H 12/22* (2013.01); *E04H 12/28* (2013.01); *E04H 12/32* (2013.01)

(58) Field of Classification Search
CPC .. E02D 27/50; E02D 5/74; E02D 5/76; E02D 2200/1621; E02D 27/08; E02D 27/425; E02D 27/42; E04H 12/22; E04H 12/28; E04H 12/32; E04H 12/08; E04B 2103/06; E04C 5/166; E04C 5/0645
USPC ..... 52/295, 294, 297, 296, 299
See application file for complete search history.

(56) References Cited

U.S. PATENT DOCUMENTS 286,086 A 10/1883 Spang
407,660 A 7/1889 Hill
(Continued)

FOREIGN PATENT DOCUMENTS

EP 1036937 9/2000

OTHER PUBLICATIONS

Mghairbi, Ahmed El, "Assessment of Earthing Systems and Enhancement of Their Performance," Thesis submitted to Cardiff University in candidature for the degree of PhD, 2012, pp. 1-205.
(Continued)

*Primary Examiner* — Phi A
(74) *Attorney, Agent, or Firm* — Buchanan Nipper

(57) ABSTRACT

Reinforcement assemblies, reinforcement fixtures, methods of constructing a reinforcement assembly, and methods of constructing a reinforcement fixture are described herein. An example embodiment of a reinforcement assembly comprises a plate, a plurality of connectors, and a plurality of elongate members. The plate comprises a plate lengthwise axis, a plate center axis, a plate top surface, a plate bottom surface, and a plate outer surface. Each connector of the plurality of connectors is attached to the plate outer surface and each elongate member of the plurality of elongate members is attached to a connector of the plurality of connectors.

13 Claims, 8 Drawing Sheets

(51) Int. Cl.

| | |
|---|---|
| ***E02D 27/08*** | (2006.01) |
| ***E02D 27/42*** | (2006.01) |
| ***E04C 5/06*** | (2006.01) |
| ***E04C 5/16*** | (2006.01) |
| *E04H 12/08* | (2006.01) |
| *E04H 12/22* | (2006.01) |
| *E04H 12/28* | (2006.01) |
| *E04H 12/32* | (2006.01) |

(56) References Cited

U.S. PATENT DOCUMENTS

| | | | | |
|---|---|---|---|---|
| 437,526 | A | 9/1890 | Spang | |
| 874,395 | A * | 12/1907 | Danielson | 52/649.4 |
| 1,008,209 | A | 11/1911 | Skinner | |
| 1,008,210 | A * | 11/1911 | Skinner | 52/260 |
| 1,516,074 | A * | 11/1924 | Borg | 52/236.9 |
| 1,743,526 | A | 12/1926 | Cage | |
| 1,919,491 | A | 12/1929 | Waggoner | |
| 2,008,931 | A | 7/1935 | Schuler | |
| 3,281,520 | A | 10/1966 | Rocard | |
| 3,600,865 | A * | 8/1971 | Vanich | E04B 1/3404 52/223.4 |
| 3,668,876 | A | 6/1972 | Koehler | |
| 3,710,526 | A * | 1/1973 | Parks | E04B 5/32 52/223.6 |
| 4,180,698 | A | 12/1979 | Carpenter, Jr. | |
| 4,228,627 | A * | 10/1980 | O'Neill | 52/295 |
| 4,658,266 | A | 4/1987 | Doty, Jr. | |
| 4,910,940 | A * | 3/1990 | Grady, II | E04B 1/18 52/223.5 |
| 5,043,527 | A | 8/1991 | Carpenter, Jr. | |
| 5,461,194 | A | 10/1995 | Roop | |
| 5,533,835 | A * | 7/1996 | Angelette | 405/229 |
| 5,537,125 | A | 7/1996 | Harrell, Jr. et al. | |
| 5,561,956 | A * | 10/1996 | Englekirk | E04B 1/41 411/383 |
| 5,826,387 | A | 10/1998 | Henderson et al. | |
| 6,123,485 | A | 9/2000 | Mirmiran et al. | |
| 6,167,896 | B1 | 1/2001 | Smith | |
| 6,657,120 | B2 | 12/2003 | Smith | |
| 6,659,691 | B1 | 12/2003 | Berry | |
| 6,672,023 | B2 | 1/2004 | Henderson | |
| 6,722,091 | B1 | 4/2004 | Leslie et al. | |
| 6,741,438 | B2 | 5/2004 | Sakai | |
| 7,070,362 | B2 | 7/2006 | Rasmussen | |
| 7,236,341 | B1 | 6/2007 | Carpenter, Jr. | |
| 7,618,217 | B2 | 11/2009 | Henderson | |
| 8,161,698 | B2 | 4/2012 | Migliore | |
| 8,383,933 | B2 | 2/2013 | Mogensen et al. | |
| 8,661,752 | B2 * | 3/2014 | Phuly | 52/296 |
| 8,695,297 | B2 * | 4/2014 | Knisel | F03D 13/22 52/223.2 |
| 8,769,893 | B1 | 7/2014 | Gill et al. | |
| 8,801,335 | B2 * | 8/2014 | Schacknies | E02D 27/42 405/229 |
| 8,833,004 | B2 * | 9/2014 | Prass | 52/169.1 |
| 9,057,170 | B2 * | 6/2015 | Tadros | E02D 5/523 |
| 2005/0117977 | A1 | 6/2005 | Rasumussen | |
| 2005/0183364 | A1 * | 8/2005 | Cash | 52/296 |
| 2005/0210767 | A1 | 9/2005 | DeFever et al. | |
| 2007/0181767 | A1 | 8/2007 | Wobben | |
| 2011/0061321 | A1 | 3/2011 | Phuly | |
| 2012/0167499 | A1 | 7/2012 | Knisel | |

OTHER PUBLICATIONS

Dehn International, "Earth-termination system," dehninternational.com, accessed Nov. 5,2014, p. 1, http://www.dehn-international/com/en/earth-termination-system-0.

Reisenauer, John, "Heavy Duty Ground Radial System for Vertical Antennas," Hamuniverse.com, accessed Nov. 5, 2014, pp. 1-2, http://www.hamuniverse.com/kl7jrgroundingring.html.

Dehn, "White Paper: Lightning and surge protection for wind turbines," Dehn + Sohne, 2012, pp. 1-12.

Oak Central, "Antenna Radiation Efficiency of the Korean NDGPS Based on Radiation Power Measurements," Central.oak.go., accessed Nov. 5, 2014, pp. 1-3, http://central.oak.go.kr/search/detailarticle.jsp?article_seq=11047&tabname=abst&resource_seq=null&keywords=null#Fig.%201.

SGC Inc., "Antenna & Ground Help," SGCworld.com, accessed Nov. 5, 2014, pp. 1-2, http://www.sgcworld.com/radialstechnote.html.

Solacity, Inc., "Wind Turbine Ground System," www.solacity.com, 2008, p. 1.

McNiff, Brian, "Wind Turbine Lightning Protection Projection," National Renewable Energy Laboratory, May 2002, pp. 1-100.

* cited by examiner

REINFORCEMENT ASSEMBLIES, FIXTURES, AND METHODS

RELATED APPLICATION

This application claims the benefit of U.S. Provisional Application No. 61/997,279, filed May 27, 2014. The disclosure of this related application is hereby incorporated into this disclosure in its entirety.

FIELD

The disclosure relates generally to the field of reinforcement assemblies, fixtures, and methods.

BACKGROUND

Conventional foundations for structures, such as wind turbines, generally include large, thick, concrete footings that include reinforcing meshes formed of reinforcement members, such as rebar. Traditionally the foundations have a square or rectangular cross section and the rebar is installed orthogonally to provide proper support for the structure supported by the foundation. The installation of the rebar is complex and generally requires assembling at least two layers of reinforcing meshes that are vertically separated between two feet and six feet apart from one another and that span the entire area of the foundation. The rebar included in these foundations must be installed using precise geometric layouts and spacing between each section of rebar to achieve the desired reinforcement of the concrete that will eventually surround the rebar. The installation of rebar having these precise geometric layouts and spacing is labor intensive, time-consuming, and requires a large number of well-trained laborers. If the rebar is not installed properly, the foundation can crack or become unfit to support the load being applied by the structure supported by the foundation.

Some foundations include radially configured reinforcing meshes formed of rebar. However, these foundations present challenges because they require multiple vertically stacked layers of reinforcing meshes, which adds complexity, time, expense, and creates a reinforcement structure that does not provide an efficient transfer of forces across the center of the foundation.

A need exists, therefore, for improved reinforcement assemblies, fixtures, and related methods.

BRIEF SUMMARY OF SELECTED EXAMPLE EMBODIMENTS

Reinforcement assemblies are described herein. An example embodiment of a reinforcement assembly comprises a plate, a plurality of connectors, and a plurality of elongate members. The plate has a plate lengthwise axis, a plate center axis, a plate top surface, a plate bottom surface, and a plate outer surface that extends from the plate top surface to the plate bottom surface. The plate top surface has a plate diameter. The plate outer surface has a plate length that is less than the plate diameter. The plate lengthwise axis passes through the plate outer surface and is disposed orthogonal to the plate center axis. Each connector of the plurality of connectors has a connector first end and a connector second end. The connector first end of each connector of the plurality of connectors is attached to the plate outer surface. The connector first end and the connector second end of each connector of the plurality of connectors are disposed on a first plane that contains the plate lengthwise axis and that is disposed orthogonally to the plate center axis. Each elongate member of the plurality of elongate members has an elongate member first end and an elongate member second end. The elongate member first end of each elongate member of the plurality of elongate member is attached to a connector of the plurality of connectors. The elongate member first end and the elongate member second end of each elongate member of the plurality of elongate members are disposed on the first plane.

Reinforcement fixtures are described herein. An example embodiment of a reinforcement fixture comprises a plate and a plurality of connectors. The plate has a plate lengthwise axis, a plate center axis, a plate top surface, a plate bottom surface, and a plate outer surface that extends from the plate top surface to the plate bottom surface. The plate top surface has a plate diameter. The plate outer surface has a plate length that is less than the plate diameter. The plate lengthwise axis passes through the plate outer surface and is disposed orthogonal to the plate center axis. Each connector of the plurality of connectors has a connector first end and a connector second end. The connector first end of each connector of the plurality of connectors is attached to the plate outer surface. The connector first end and the connector second end of each connector of the plurality of connectors are disposed on a first plane that contains the plate lengthwise axis and that is disposed orthogonally to the plate center axis.

Methods of constructing a reinforcement assembly are also described herein. An example method of constructing a reinforcement assembly comprises the following steps: obtaining a plate that has a plate lengthwise axis, a plate center axis, a plate top surface, a plate bottom surface, and a plate outer surface that extends from the plate top surface to the plate bottom surface, the plate lengthwise axis is disposed orthogonal to the plate center axis; obtaining a plurality of connectors, each connector of the plurality of connectors has a connector first end, a connector second end, and a connector length that extends from the connector first end to the connector second end; obtaining a plurality of elongate members, each elongate member of the plurality of elongate members has an elongate member first end, an elongate member second end, and an elongate member length that extends from the elongate member first end to the elongate member second end; attaching each connector of the plurality of connectors to the plate outer surface such that each of the connector first end, the connector second end, and the entire connector length of each connector of the plurality of connectors is disposed on a first plane that contains the plate lengthwise axis and is disposed orthogonal to the plate center axis; attaching each elongate member of the plurality of elongate members to a connector of the plurality of connectors such that each of the elongate member first end, the elongate member second end, and the entire elongate member length of each elongate member of the plurality of elongate members is disposed on the first plane.

Methods of constructing a reinforcement fixture are also described herein. An example method of constructing a reinforcement fixture comprises the following steps: obtaining a plate that has a plate lengthwise axis, a plate center axis, a plate top surface, a plate bottom surface, and a plate outer surface that extends from the plate top surface to the plate bottom surface, the plate lengthwise axis is disposed orthogonal to the plate center axis; obtaining a plurality of connectors, each connector of the plurality of connectors has a connector first end, a connector second end, and a connector length that extends from the connector first end to the connector second end; attaching each connector of the plurality of connectors to the plate outer surface such that each of the connector first end, the connector second end, and the entire connector length of each connector of the plurality of connectors is disposed on a first plane that contains the plate lengthwise axis and is disposed orthogonal to the plate center axis.

DETAILED DESCRIPTION

The following detailed description and the appended drawings describe and illustrate various example embodiments of reinforcement assemblies, reinforcement fixtures, methods of constructing a reinforcement assembly, and methods of constructing a reinforcement fixture. The description and illustration of these examples are provided to enable one skilled in the art to make and use a reinforcement assembly and to practice a method of constructing a reinforcement assembly. They are not intended to limit the scope of the claims in any manner.

The use of "e.g.," "example," and "or," and grammatically related terms, indicates non-exclusive alternatives without limitation, unless otherwise noted. The term "diameter" refers to the length of a straight line passing from side to side through the center of a body, element, or feature, and does not impart any structural configuration on the body, element, or feature.

Figure 1:
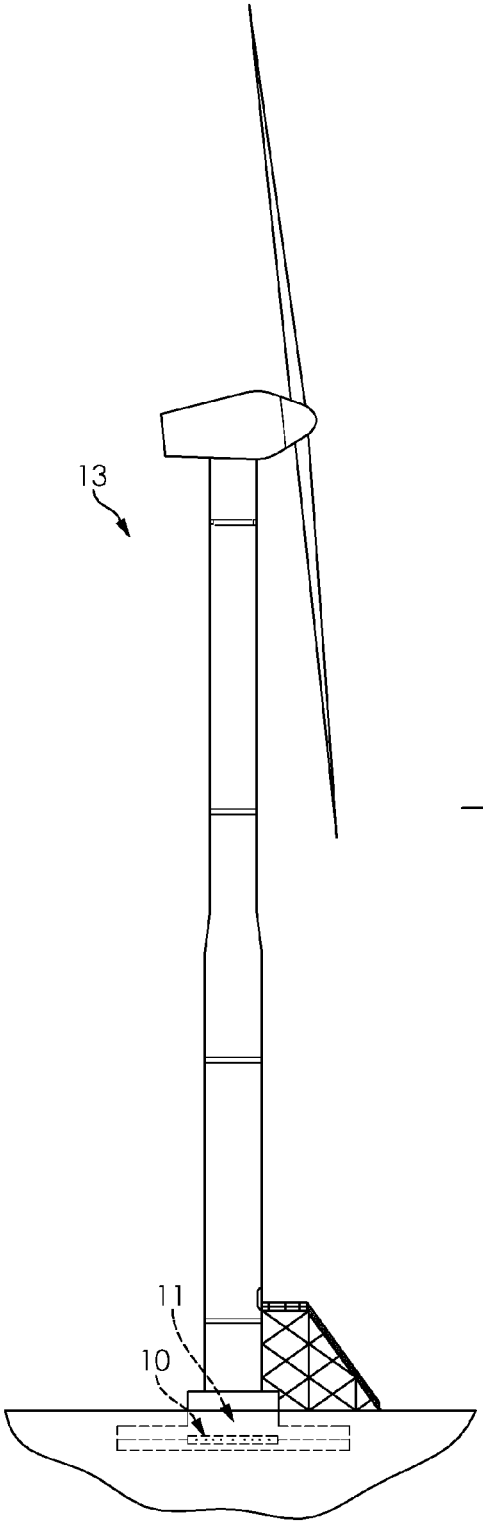
FIG. 1 is an elevation view of a wind turbine that is disposed on a foundation that includes an example embodiment of a reinforcement assembly.
Figure 2:
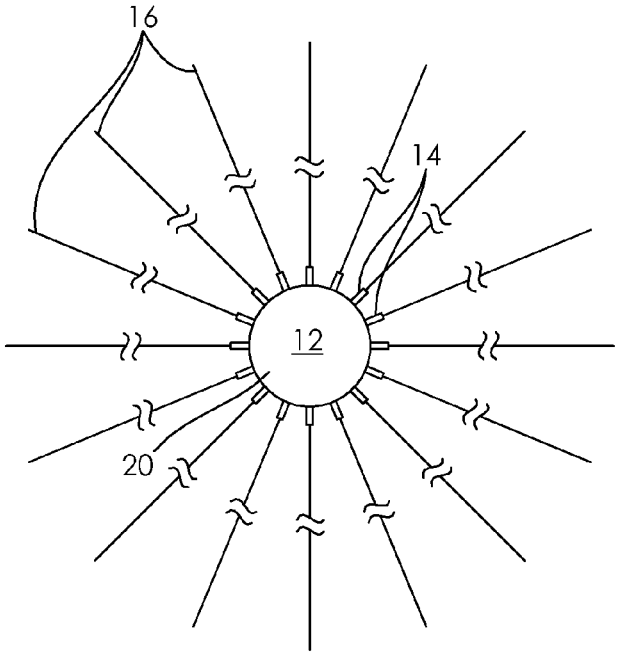
FIG. 2 is a top view of the reinforcement assembly illustrated in FIG. 1 free of the foundation.
Figure 3:
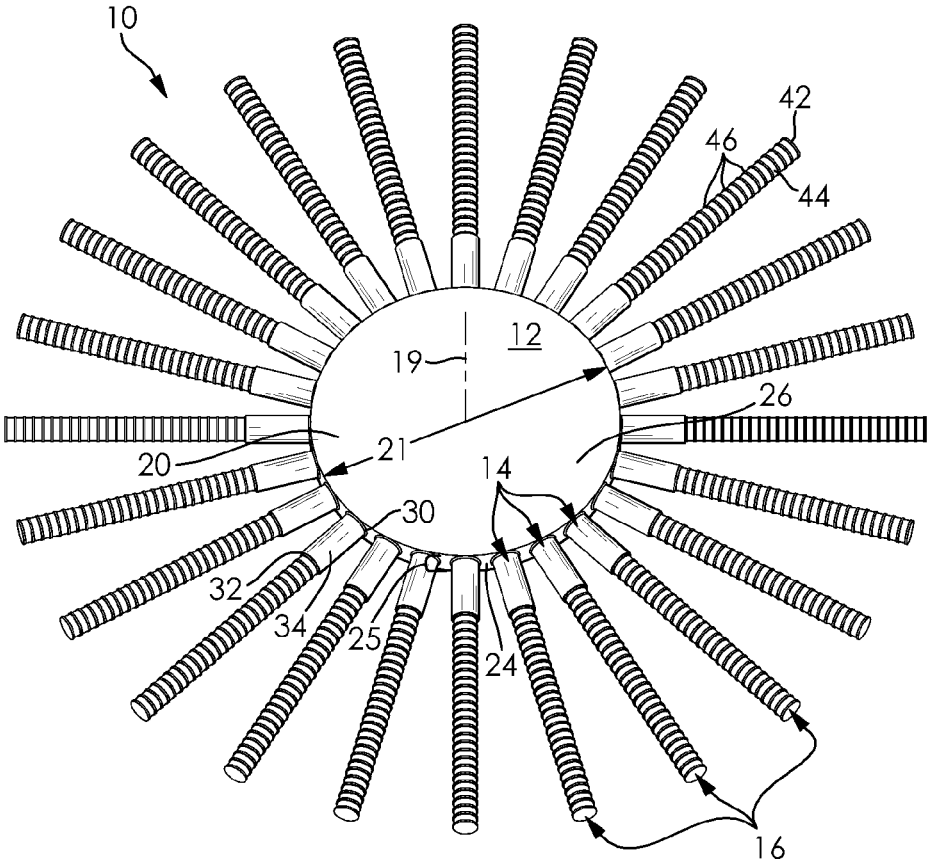
FIG. 3 is a perspective view of the reinforcement assembly illustrated in FIG. 2.

FIGS. 1, 2, 3, 4, 5, 6, and 7 illustrate an example embodiment of a reinforcement assembly 10 that comprises a plate 12, a plurality of connectors 14, and a plurality of elongate members 16. FIG. 1 illustrates the reinforcement assembly 10 disposed within a foundation 11 that supports a wind turbine 13.

The plate 12 has a plate lengthwise axis 17, a plate center axis 19, a plate top surface 20, a plate bottom surface 22, a plate outer surface 24, and a plate body 26. The plate lengthwise axis 17 is disposed orthogonal to the plate center axis 19 and passes through the plate outer surface 24. The plate top surface 20 has a first plate diameter 21 and the plate bottom surface 22 has a second plate diameter 23 that is equal to the first plate diameter 21. The plate outer surface 24 extends from the plate top surface 20 to the plate bottom surface 22 and has a plate length 25 that extends from the plate top surface 20 to the plate bottom surface 22. The plate length 25 is less than the first plate diameter 21 and the second plate diameter 23. The plate outer surface 24 is disposed from the plate center axis 19 by a distance 27.

In the illustrated embodiment, the plate 12 is formed of metal and comprises a cylindrical member that has a continuous, uninterrupted, surface along the first plate diameter 21, the second plate diameter 23, and the plate outer surface 24. While the plate 12 has been illustrated as being formed of metal and comprising a cylindrical member having multiple continuous, uninterrupted, surfaces, a plate can be formed of any suitable material and have any suitable structural configuration. Selection of a suitable material to form a plate and a suitable structural configuration for a plate can be based on various considerations, including the intended use of a reinforcement assembly of which the plate is a component. Example materials considered suitable to form a plate included in a reinforcement assembly include rigid materials, metals, such as steel, stainless steel, tempered steel, carbon steel, galvanized steel, steel that contains manganese, silicon, and/or carbon, metals that include one or more coatings (e.g., epoxy, anti-rust), alloys, and any other material considered suitable for a particular embodiment.

Example structural configurations considered suitable for a plate include plates that are cylindrical, cuboidal, a cube, hexagonal prisms, rings, plates that define a hollow chamber, plates that define a chamber that is accessible through one or more passageways and/or a recess that extends from a plate top surface and toward a plate bottom surface or from a plate bottom surface and toward a plate bottom surface such that one or more other components (e.g., concrete, reinforcing members, rebar) can be disposed within the chamber and/or recess, plates that have a first plate diameter that is equal to, substantially equal to, greater than, or less than, a second plate diameter, plates that have a first plate diameter that is equal to, substantially equal to, greater than, or less than, the outside diameter of the structure (e.g., wind turbine tower, wind turbine tower section) intended to be disposed on a reinforcement assembly, or on a foundation within which a reinforcement assembly is disposed, plates that have a plate length that is equal to, substantially equal to, greater than, or less than a first plate diameter, plates that define a plurality of projections on the plate top surface, each projection of the plurality of projections extends from the plate top surface and away from the plate bottom surface, plates that define a plurality of projections on the plate bottom surface, each projection of the plurality of projections extends from the plate bottom surface and away from the plate top surface, plates that define a plurality of projections on a plate outer surface, each projection of the plurality of projections extends from the plate outer surface and away from the plate center axis, plates that define a first plurality of projections on the plate top surface, a second plurality of projections on the plate bottom surface, and/or a third plurality of projections on the plate outer surface, plates that have a plate top surface and/or a plate bottom surface that is planar, curved, and/or multifaceted, combinations of the configurations described herein, and any other structural configuration considered suitable for a particular embodiment. Selection of the size (e.g., plate diameter, plate length) and/or shape (e.g., cylindrical, cuboidal) of a plate to include in a reinforcement assembly can be based on various considerations such as the load intended to be supported by the reinforcement assembly, the load intended to be supported by a foundation that includes the reinforcement assembly, the size and/or shape (e.g., connector length) of a connector, or each connector of a plurality of connectors, intended to be attached to the plate, and/or the size and/or shape (e.g., elongate member length) of an elongate member, or each elongate member of a plurality of elongate members, intended to be attached to a connector, or to a connector of the plurality of connectors. Alternative embodiments of a reinforcement assembly or reinforcement fixture can include one or more mounting stands disposed on, releasably attached to, fixedly attached to (e.g., welded), or contacting the plate top surface and/or the plate bottom surface of the reinforcement assembly or reinforcement fixture. Each mounting stand extends away from the plane that contains the plate lengthwise axis and that is disposed orthogonal to the plate center axis. Each mounting stand comprises a structure that is sized and configured to separate a reinforcement assembly or reinforcement fixture from another component, feature, or structure. Any suitable structure can be used as a mounting stand and selection of suitable mounting stands can be based on various considerations, such as the material(s) that form a plate of a reinforcing assembly or reinforcement fixture and/or the type of component being separated from the plate of the reinforcement assembly or reinforcement fixture. Example structures considered suitable to use as a mounting stand include elongate members, metal plates, concrete blocks, spacers formed of any suitable material (e.g., polymers, plastic, metal), wire members, and any other structure considered suitable for a particular embodiment.

Figure 4:
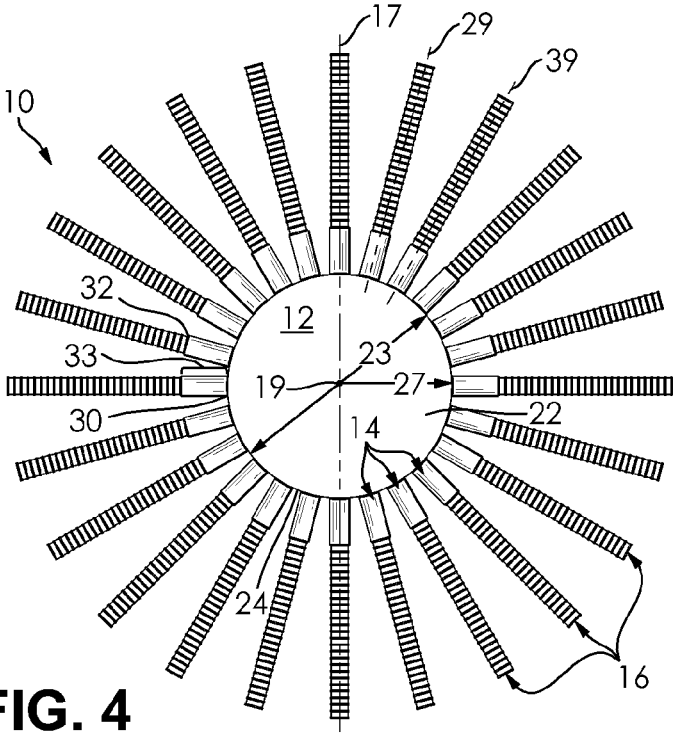
FIG. 4 is a bottom view of the reinforcement assembly illustrated in FIG. 2.
Figure 5:
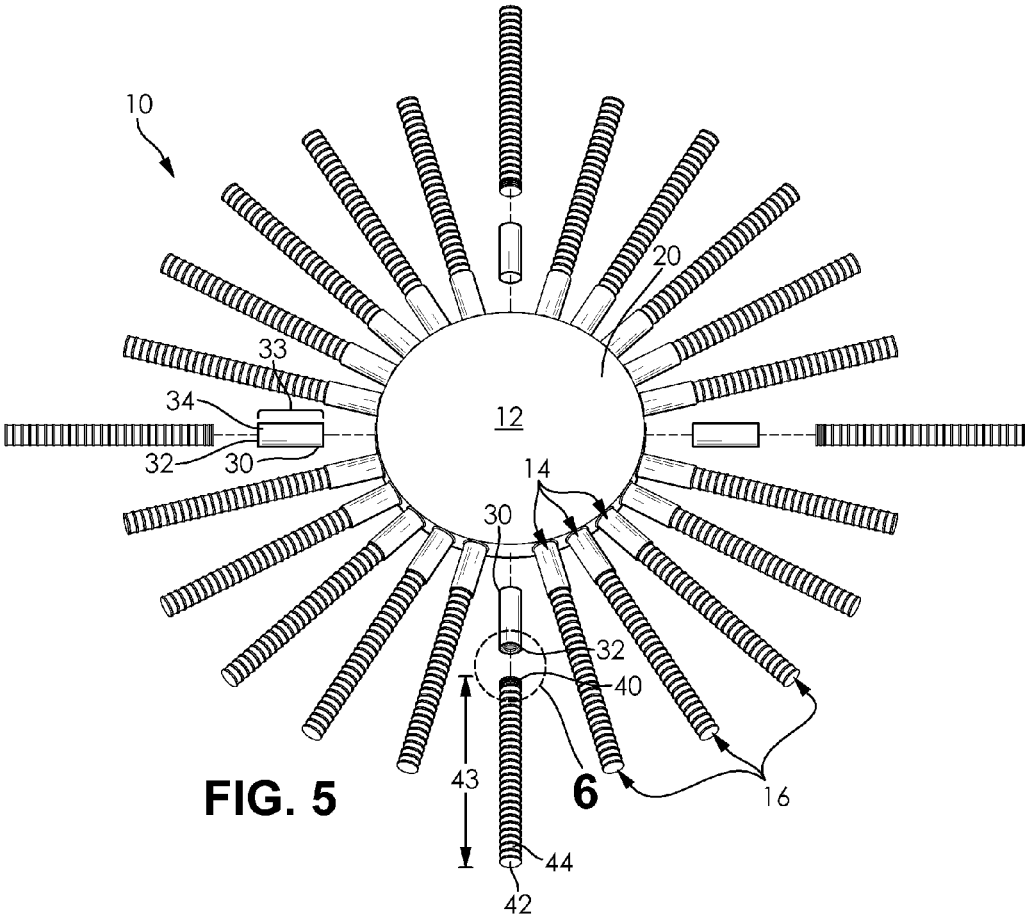
FIG. 5 is a partial exploded view of the reinforcement assembly illustrated in FIG. 2.

In the illustrated embodiment, each connector of the plurality of connectors 14 has a connector lengthwise axis 29, as shown in FIG. 4, a connector first end 30, a connector second end 32, a connector length 33, and a connector body 34 that defines a recess 36 and internal threads 38. In the illustrated embodiment, each connector of the plurality of connectors 14 is formed of metal and comprises a cylindrical member. The connector length 33 extends from the connector first end 30 to the connector second end 32 and is less than the first plate diameter 21 and the second plate diameter 23. The recess 36 extends into the connector body 34 from the connector second end 32 and toward the connector first end 30. The internal threads 38 are defined within the recess 36 and extend from the connector second end 32 toward the connector first end 30. The recess 36 and the internal threads 38 are sized and configured to mate with the external threads 48 defined by the elongate member body 44 of an elongate member of the plurality of elongate members 16, as described herein.

In the illustrated embodiment, the connector first end 30 of each connector of the plurality of connectors 14 is attached to the plate outer surface 24 by welding each connector of the plurality of connectors 14 to the plate 12. Each connector of the plurality of connectors 14 extends from the connector first end 30 and away from the plate center axis 19 such that it extends radially outward from the plate outer surface 24. The connector first end 30 and the connector second end 32 of each connector of the plurality of connectors 14 is disposed on a plane 35 that contains the plate lengthwise axis 17 and that is disposed orthogonally to the plate center axis 19. In the illustrated embodiment, the plane 35 is disposed at the midpoint of the plate length 25 and the entire connector length 33 of each connector of the plurality of connectors 14 is disposed on the plane 35 (e.g., the connector lengthwise axis 29 of each connector of the plurality of connectors 14 is disposed on plane 35).

While the connector first end 30 of each connector of the plurality of connectors 14 has been illustrated as welded to the plate 12, a connector can be attached to a plate using any suitable technique or method of attachment. Selection of a suitable technique or method of attachment to attach a connector of the plurality of connectors to a plate can be can based on various considerations, such as the material(s) that form a connector and/or plate. Example techniques or methods of attachment considered suitable to attach a connector to a plate include using threaded connections, friction fit connections, welding, arc welding, metal inert gas welding (MIG), tungsten inert gas welding (TIG), friction welding, and any other technique or method of attachment considered suitable for a particular embodiment. For example, in alternative embodiments, the plate body of a reinforcement assembly or reinforcement fixture can define a plurality of recesses. Each recess of the plurality of recesses extends from the outer surface of the plate and toward the plate center axis, or an axis parallel to the plate center axis. The plate body of these alternative embodiments defines internal threads within each recess, or one or more of the recesses, that are sized and configured to mate with the external threads defined by a connector of the plurality of connectors. Alternatively, a plate body of a reinforcement assembly or reinforcement fixture can define a plurality of projections. Each projection of the plurality of projections extends from the outer surface of the plate and away from the plate center axis, or an axis parallel to the plate center axis. The plate body of these alternative embodiments defines external threads on each projection, or one or more of the projections, that are sized and configured to mate with the internal threads defined by a connector of the plurality of connectors.

While each connector of the plurality of connectors 14 has been illustrated as being formed of metal and comprising a cylindrical member, a connector can be formed of any suitable material and have any suitable structural configuration. Selection of a suitable material to form a connector and a suitable structural configuration for a connector can be based on various considerations, including the intended use of the reinforcement assembly. Example materials considered suitable to form a connector included in a reinforcement assembly include rigid materials, metals, such as steel, stainless steel, tempered steel, carbon steel, steel that contains manganese, silicon, and/or carbon, metals that include one or more coatings (e.g., epoxy, anti-rust), alloys, and any other material considered suitable for a particular embodiment. Example structural configurations considered suitable for a connector include connectors that define exterior threads that extend from the connector first end toward the connector second end that are sized and configured to mate with internal threads defined within a recess defined by the plate body, connectors that define a recess and internal threads (e.g., that extend from the connector first end toward the connector second end, that extend from the connector second end toward the connector first end), connectors that define a recess and omit the inclusion of internal threads, connectors that comprise a solid member (e.g., solid cylindrical member), connectors that comprise elongate members, such as those described herein, connectors that comprise reinforcing rods (e.g., rebar), connectors that use one or more set screws to attach an elongate member to the connector, connectors that define a recess that tapers from the connector second end toward the connector first end, connectors that taper from a location between the connector first end and the connector second end toward the connector second end, connectors that are movable between a first configuration in which an elongate member is free of attachment to the connector and a second configuration in which the elongate member is attached to the connector, connectors that are compressible on an elongate member, connectors that are sized and configured to provide a friction fit between the connector and an elongate member, and any other connector considered suitable for a particular embodiment. Alternatively, a recess defined by a connector can comprise a passageway that extends through the entire length of the connector. In embodiments in which one or more connectors are included in the reinforcement assembly that use one or more set screws to attach an elongate member to each connector, the connector body defines one or more passageways that extend through the connector body and provide access to a recess defined by the connector. The passageways can be positioned in any suitable arrangement on the connector (e.g., a first row that is disposed on a first axis that is parallel to the connector lengthwise axis, a second row that is disposed on an axis that is parallel to the first axis and the connector lengthwise axis). Each passageway of the one or more passageways defined by the connector body defines threads that are sized and configured to mate with the threads defined by a set screw. In these alternative embodiments, an elongate member is positioned within the recess defined by the connector and each set screw, or one or more set screws, included on the connector is tightened onto the elongate member to attach the elongate member to the connector.

While each connector of the plurality of connectors 14 has been illustrated as attached to the plate outer surface 24, a connector, or a plurality of connectors, can be attached to any suitable surface of a plate. Selection of a suitable surface to attach a connector, or a plurality of connectors, to a plate can be based on various considerations, such as the intended use of a reinforcement assembly of which the connector, or plurality of connectors, is a component. Example surfaces of a plate considered suitable to attach a connector, or a plurality of connectors, include a plate outer surface, a plate top surface, a plate bottom surface, a surface between a plate top surface and a plate bottom surface, a surface between a first plane that contains a portion, or the entirety, of a plate top surface and a second plane that contains a portion, or the entirety, of a plate bottom surface, and any other surface considered suitable for a particular embodiment.

While the connector first end 30, the connector second end 32, and the entire connector length 33 of each connector of the plurality of connectors 14 has been illustrated as disposed on the plane 35 that contains the plate lengthwise axis 17, any suitable portion of a connector can be positioned on a plane that contains the plate lengthwise axis. Selection of a suitable portion of a connector to position on a plane that contains the plate lengthwise axis can be based on various considerations, including the structural arrangement of a plate and/or connector. Example portions of a connector considered suitable to position on a plane that contains the plate lengthwise axis include a connector first end, a connector second end, a portion of the connector length, the entire connector length, and/or any other portion of a connector considered suitable for a particular embodiment. For example, the connector lengthwise axis of each connector of a plurality of connectors, or one or more connectors of a plurality of connectors, included in a reinforcement assembly can be disposed parallel to, or at an angle to, a plane that contains the plate lengthwise axis and that is disposed orthogonal to, or at an angle to, the plate center axis.

While the plane 35 has been illustrated as being disposed at the midpoint of the plate length 25, a plane that contains the plate lengthwise axis and that is disposed orthogonally to the plate center axis can be disposed at any suitable location along the plate length. Alternatively, a plane that contains the plate lengthwise can be disposed at angles other than 90 degrees relative to the plate center axis. Selection of a suitable location to position a plane on a plate length or a suitable angle to position a plane relative to a plate center axis can be based on various considerations, including the intended use of a reinforcement assembly that includes a plurality of connectors. Example locations considered suitable to position a plane along a plate length include at the midpoint of the plate length, between the plate top surface and the midpoint of the plate length, between the plate bottom surface and the midpoint of the plate length, and at any other location considered suitable for a particular embodiment. Example angles considered suitable to position a plane that contains the plate lengthwise axis relative to the plate center axis include angles equal to, substantially equal to, less than, or greater than, 90 degrees, 80 degrees, 70 degrees, and any other angle considered suitable for a particular embodiment.

While each connector of the plurality of connectors 14 has been illustrated as extending radially outward from the plate outer surface 24, a connector, or each connector in a plurality of connectors, can extend from a surface of a plate (e.g., plate outer surface) in any suitable direction. Selection of a suitable direction for a connector, or each connector in a plurality of connectors, to extend from a surface of a plate can be based on various considerations, including the intended use of the reinforcement assembly. Example directions considered suitable for a connector, or each connector of a plurality of connectors, to extend from a surface of a plate include radially outward from a surface (e.g., top surface, bottom surface, outer surface) of a plate, such that the connector, or each connector of the plurality of connectors, is disposed on an axis that is parallel to the plate lengthwise of a plate to which the connector, or the plurality of connectors, is attached, such that the connector, or each connector of the plurality of connectors, is disposed on an axis that is orthogonal to the plate lengthwise of a plate to which the connector, or the plurality of connectors, is attached, such that the connector, or each connector of the plurality of connectors, is disposed on an axis that is disposed at angle to the plate lengthwise of a plate to which the connector, or the plurality of connectors, is attached, such that the connector, or each connector of the plurality of connectors, is disposed on an axis that is disposed at an angle to a plane that contains the plate lengthwise and is orthogonal to the plate center axis of the plate to which the connector, or the plurality of connectors, is attached, a combination of the configurations described, and any other configuration considered suitable for a particular embodiment.

While a plurality of connectors 14 has been illustrated as included in reinforcement assembly 10, a reinforcement assembly can include any suitable number of connectors and selection of a suitable number of connectors can be based on various considerations, including the structural configuration of a plate to which the plurality of connectors is intended to be attached and/or the intended use of the reinforcement assembly. Example numbers of connectors considered suitable to include in a reinforcement assembly include one, at least one, two, a plurality, three, four, five, more than five, more than ten, more than twenty, twenty-four, and any other number considered suitable for a particular embodiment. In the illustrated embodiment, the reinforcement assembly 10 includes twenty-four connectors.

Each connector of the plurality of connectors 14 included in the reinforcement assembly 10 can have any suitable diameter that is measured on an axis that is disposed orthogonal to the connector lengthwise axis. Selection of a suitable diameter for a connector of a plurality of connectors can be based on various considerations, including the plate length, the plate diameter, the load intended to be support by a reinforcement assembly, and/or the diameter of an elongate member intended to be attached to the connector. Example diameters considered suitable for each connector of a plurality connectors, or one or more connectors of a plurality of connectors, include diameters that are less than a plate diameter, less than a plate length, greater than the diameter of an elongate member included in a reinforcement assembly, equal to the diameter of an elongate member included in a reinforcement assembly, and any other diameter considered suitable for a particular embodiment.

Figure 6:
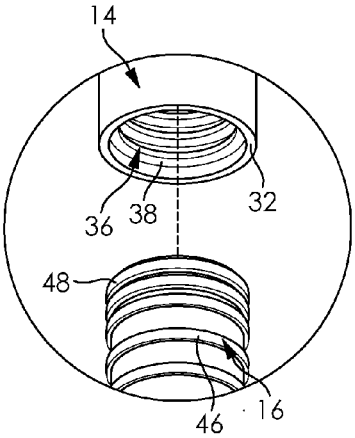
FIG. 6 is a magnified view of area 6 illustrated in FIG. 5.
Figure 7:
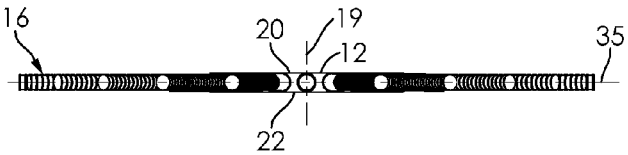
FIG. 7 is a side view of the reinforcement assembly illustrated in FIG. 2.

In the illustrated embodiment, each elongate member of the plurality of elongate members 16 comprises a steel reinforcing rod. Each elongate member of the plurality of elongate members 16 has an elongate member lengthwise axis 39, as shown in FIG. 4, an elongate member first end 40, an elongate member second end 42, an elongate member length 43, and an elongate member body 44 that defines a plurality of ridges 46 and external threads 48. In the illustrated embodiment, each elongate member of the plurality of elongate member 16 comprises a cylindrical member that includes a plurality of ridges 46. The elongate member length 43 extends from the elongate member first end 40 to the elongate member second end 42 and is greater than the first plate diameter 21 and the second plate diameter 23. Each ridge of the plurality of ridges 46 extends outward and away from the elongate member lengthwise axis 39 and increases the adhesion between each elongate member of the plurality of elongate member 16 and concrete when the reinforcement assembly 10 is disposed within a concrete foundation. In the illustrated embodiment, each ridge of the plurality of ridges 46 is a circumferential ridge. The external threads 48, as shown in FIG. 6, are defined on an exterior surface of each elongate member of the plurality of elongate members 16 and extend from the elongate member first end 40 toward the elongate member second end 42. The external threads 48 are sized and configured to mate with the internal threads 38 defined by the connector body 34 of a connector of the plurality of connectors 14, as described herein.

In the illustrated embodiment, the elongate member first end 40 of each elongate member of the plurality of elongate member 16 is attached to a connector of the plurality of connectors 14 using the mating configuration of threads 38 and threads 48. This can be accomplished by positioning a portion of an elongate member first end 40 of an elongate member 16 within the recess 36 defined by a connector 14 and applying a rotational force on the elongate member 16 until a desired amount of torque is applied to the elongate member 16. When assembled, the elongate member first end 40 and the elongate member second end 42 of each elongate member of the plurality of elongate members 16 is disposed on the plane 35 that contains the plate lengthwise axis 17 and is disposed orthogonally to the plate center axis 19. In the illustrated embodiment, the entire elongate member length 43 of each elongate member of the plurality of elongate members 16 is disposed on the plane 35 that contains the plate lengthwise axis 17 (e.g., the elongate member lengthwise axis 39 of each elongate member of the plurality of elongate members 16 is disposed on plane 35). Each elongate member of the plurality of elongate member 16 extends from the elongate member first end 40 and away from the plate center axis 19. In the illustrated embodiment, each elongate member of the plurality of elongate member 16 extends outward and away from a connector of the plurality of connectors 14 such that the lengthwise axis 39 of the elongate member 16 is coaxial with the lengthwise axis 29 of the connector 14 to which it is attached.

While the reinforcement assembly 10 has been illustrated as comprising a plate 12, a plurality of connectors 14, and a plurality of elongate members 16, a reinforcement assembly or reinforcement fixture can alternatively comprise a plate, or a plate and a plurality of connectors. Selection of suitable components to include in a reinforcement assembly or reinforcement fixture can be based on various considerations, including the intended use of the reinforcement assembly. For example, in embodiments in which the reinforcement assembly comprises a plate and a plurality of connectors, the inclusion of one or more elongate members on the reinforcement assembly can be determined at a work site and be customized based on the structure intended to be positioned on a foundation that contains the reinforcement assembly.

When installed in a foundation, the reinforcement assembly 10 provides a mechanism for continuously transferring loads across the center of the plate 12 and allows for the plurality of elongate members 16 to be installed in a radial configuration, or other configuration as described herein, such that each elongate member of the plurality of elongate members 16 effectively transfers loads across the center of the radial intersection, or plate 12. This is considered advantageous for use in foundations on which tall structures are intended to be installed and that are subject to 360 degree wind loads, like wind turbines as shown in FIG. 1. Any suitable number of reinforcement assemblies, such as those described herein, can be installed in a foundation on which a structure is intended to be installed. Example numbers of reinforcement assemblies considered suitable to install in a foundation include one, at least one, two, a plurality, three, and any other number considered suitable for a particular embodiment. For example, a single reinforcement assembly can be installed in a foundation supporting a structure, such as a wind turbine, since the reinforcement assemblies described herein allow for a continuous and fully developed load path across the center of the foundation in one layer.

While the reinforcement assembly 10 has been illustrated in FIG. 1 as installed in a foundation that supports a wind turbine, one or more reinforcement assemblies can be installed in a foundation that supports any suitable structure. Selection of a suitable structure to support using a foundation that includes one or more reinforcement assemblies can be based on various considerations, including the height of the structure and/or the wind loads the structure may encounter. Example structures considered suitable to support using a foundation that includes one or more reinforcement assemblies include towers, wind turbines, smokestacks, flagpoles, and any other structure considered suitable for a particular embodiment.

While the elongate member first end 40 of each elongate member of the plurality of elongate member 16 has been illustrated as attached to a connector of the plurality of connectors 14 using a threaded attachment, an elongate member can be attached to a connector using any suitable technique or method of attachment. Selection of a suitable technique or method of attachment to attach an elongate member to a connector of the plurality of connectors can be can based on various considerations, such as the structural configuration and/or the material(s) that form a connector. Example techniques or methods of attachment considered suitable to attach an elongate member to a connector include using threaded connections, using one or more set screws, using a compressible connector that can be compressed onto an elongate member to accomplish attachment of an elongate member to the connector, friction fit connections, welding, arc welding, metal inert gas welding (MIG), tungsten inert gas welding (TIG), friction welding, and any other technique or method of attachment considered suitable for a particular embodiment.

While each elongate member of the plurality of elongate member 16 has been illustrated as a steel reinforcing rod, as being formed of metal, and comprising a cylindrical member having a plurality of ridges 46, an elongate member can be formed of any suitable material and have any suitable structural configuration. Selection of a suitable material to form an elongate member and a suitable structural configuration for an elongate member can be based on various considerations, including the intended use of the reinforcement assembly. Example materials considered suitable to form an elongate member included in a reinforcement assembly include rigid materials, metals, such as steel, stainless steel, tempered steel, carbon steel, steel that contains manganese, silicon, and/or carbon, metals that include one or more coatings (e.g., epoxy, anti-rust), alloys, and any other material considered suitable for a particular embodiment. Example structural configurations considered suitable for an elongate member include elongate members that are steel reinforcing members, elongate members that omit the inclusion of a plurality of ridges, elongate members that define a plurality of recesses, each recess of the plurality of recesses extending from the outer surface of the elongate member and toward the elongate member lengthwise axis, combinations of the configurations described herein, and any other configuration considered suitable for a particular embodiment.

While the elongate member first end 40, the elongate member second end 42, and the entire elongate member length 43 of each elongate member of the plurality of elongate member 16 has been illustrated as disposed on the plane 35 that contains the plate lengthwise axis 17, any suitable portion of an elongate member can be positioned on a plane that contains the plate lengthwise axis. Selection of a suitable portion of an elongate member to position on a plane that contains the plate lengthwise axis can be based on various considerations, including the structural arrangement of a plate and/or connector. Example portions of an elongate member considered suitable to position on a plane that contains the plate lengthwise axis and is disposed at an angle to the plate center axis (e.g., orthogonal) include an elongate member first end, an elongate member second end, a portion of the elongate member length, the entire elongate member length, and/or any other portion considered suitable for a particular embodiment. For example, the elongate member lengthwise axis of each elongate member of a plurality of elongate members, or one or more elongate members of a plurality of elongate members, included in a reinforcement assembly can be disposed parallel to, or at an angle to, a plane that contains the plate lengthwise axis and that is disposed orthogonal to, or at an angle to, the plate center axis.

While the lengthwise axis 39 of each elongate member of the plurality of elongate members 16 has been illustrated as being coaxial with the connector lengthwise axis 29 of a connector of the plurality of connectors 14, an elongate member can extend from a connector in any suitable direction. Selection of a suitable direction for an elongate member, or each elongate member in a plurality of elongate members, to extend from a connector can be based on various considerations, including the intended use of the reinforcement assembly. Example directions considered suitable for an elongate member, or each elongate member of a plurality of elongate members, to extend from a connector include directions such that the elongate member lengthwise axis is coaxial with the connector lengthwise axis, such that a portion of the elongate member, or a portion of each elongate member of a plurality of elongate members, is disposed at an angle to a connector lengthwise axis, a plane that contains a plate lengthwise axis, and/or a plane that contains a plate lengthwise axis that is disposed orthogonal to a plate center axis, and any other direction considered suitable for a particular embodiment.

While each ridge of the plurality of ridges 46 has been illustrated as a circumferential ridge, a ridge included on an elongate member can have any suitable structural arrangement and selection of a suitable structural arrangement for a ridge included on an elongate member can be based on various considerations, including the intended use of the reinforcement assembly of which the elongate member is a component. Example structural arrangements for a ridge included on an elongate member include circumferential, helical, linear, curved, ridges that extend about the entire circumference of the elongate member, ridges that extend about a portion of the circumference of the elongate member, ridges that form a crosshatched configuration, and any other structural arrangement considered suitable for a particular embodiment.

While a plurality of elongate members 16 has been illustrated as included in reinforcement assembly 10, a reinforcement assembly can include any suitable number of elongate members and selection of a suitable number of elongate members can be based on various considerations, including the number of connectors included in the reinforcement assembly, the structural configuration of a connector to which an elongate member is intended to be attached, and/or the intended use of the reinforcement assembly. Example numbers of elongate members considered suitable to include on a reinforcement assembly include one, at least one, two, a plurality, three, four, five, more than five, more than ten, more than twenty, twenty-four, and any other number considered suitable for a particular embodiment. For example, depending on the load intended to be disposed on the reinforcement assembly, or a foundation that include one or more reinforcement assemblies, a reinforcement assembly can include a custom number of elongate members that is based on the load intended to be supported by the reinforcement assembly, or the foundation that include one or more reinforcement assemblies. In the illustrated embodiment, the reinforcement assembly 10 includes twenty-four elongate members.

Each elongate member of the plurality of elongate members 16 included in the reinforcement assembly 10 can have any suitable diameter that is measured on an axis that is disposed orthogonal to the elongate member lengthwise axis. Selection of a suitable diameter for a elongate member of a plurality of elongate members can be based on various considerations, including the plate length, the plate diameter, the load intended to be support by a reinforcement assembly, and/or the diameter of a connector to which an elongate member is intended to be attached. Example diameters considered suitable for each elongate member of a plurality elongate members, or one or more elongate members of a plurality of elongate members, include diameters that are less than a plate diameter, less than a plate length, less than the diameter of a connector included in a reinforcement assembly, equal to the diameter of a connector included in a reinforcement assembly, and any other diameter considered suitable for a particular embodiment.

While a single reinforcement assembly 10 has been illustrated as included in a foundation 11 that supports a wind turbine 13 in FIG. 1, any suitable number of reinforcement assemblies can be disposed within a foundation that supports a structure. Selection of a suitable number of reinforcement assemblies to include in a foundation can be based on various considerations, including the size of the load intended to be support by the foundation that includes one or more reinforcement assemblies. Example numbers of reinforcement assemblies to include in a foundation include one, at least one, two, a plurality, three, four, five, more than five, and any other number considered suitable for a particular embodiment.

When multiple reinforcement assemblies are include in a foundation that supports a structure, the reinforcement assemblies can be arranged in any suitable configuration. Selection of a suitable arrangement to position multiple reinforcement fixtures can be based on various considerations, including the size, shape, and weight of the structure intended to be supported by a foundation that includes the reinforcement assemblies. Example arrangements for multiple reinforcement assemblies included in a foundation include arrangements that position a first reinforcement assembly above a second reinforcement assembly such that the plate center axis of the first reinforcement assembly is coaxial with the plate center axis of the second reinforcement assembly, arrangements that position a first reinforcement assembly near a second reinforcement assembly such that the plate center axis of the first reinforcement assembly is offset from (e.g., not coaxial with) the plate center axis of the second reinforcement assembly, arrangements that position a first reinforcement assembly adjacent to a second reinforcement assembly such that the plate lengthwise axis of the first reinforcement assembly is coaxial with the lengthwise axis of the second reinforcement assembly, arrangements that position a first reinforcement assembly near a second reinforcement assembly such that the plate lengthwise axis of the first reinforcement assembly is offset from (e.g., not coaxial with) the lengthwise axis of the second reinforcement assembly, and any other arrangement considered suitable for a particular embodiment.

Figure 8:
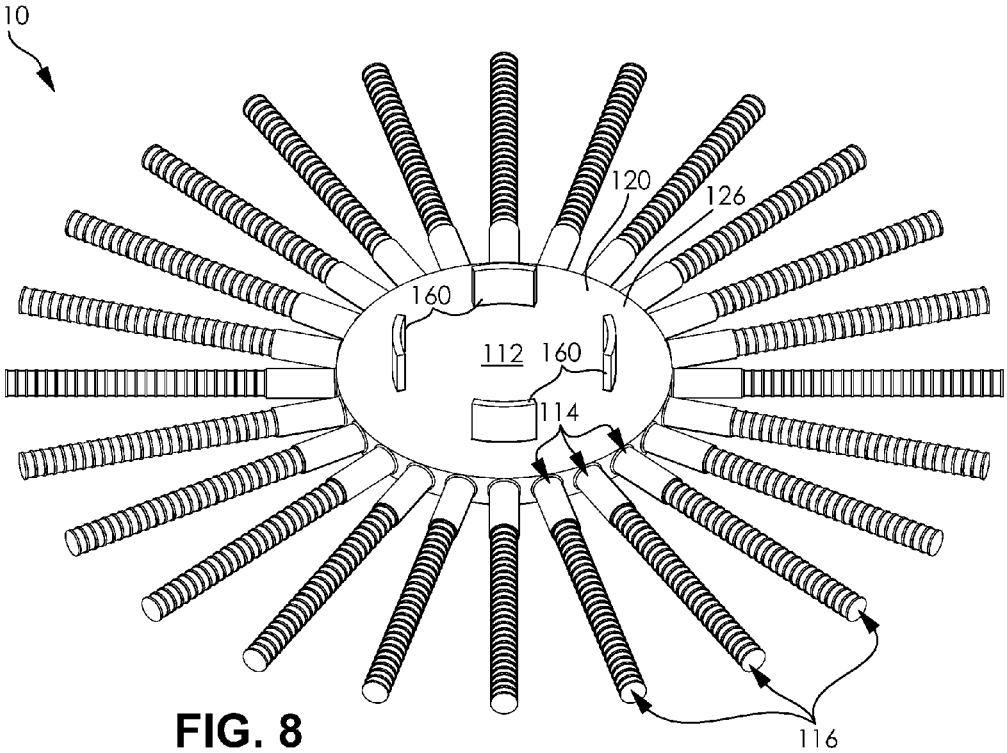
FIG. 8 is a perspective view of another reinforcement assembly.
Figure 9:
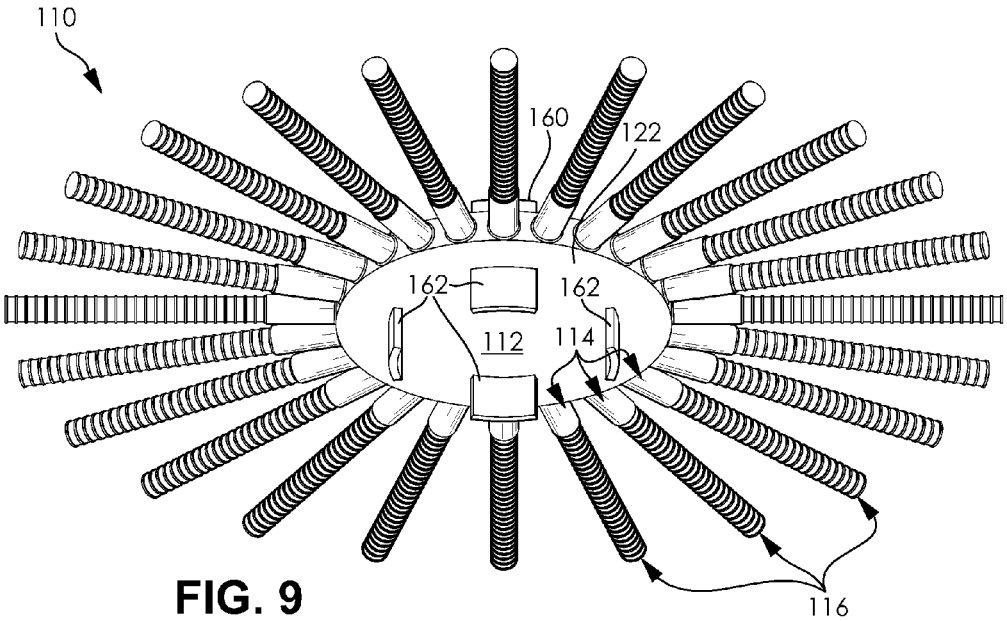
FIG. 9 is another perspective view of the reinforcement assembly illustrated in FIG. 8.

FIGS. 8 and 9 illustrate another example embodiment of a reinforcement assembly 110. The reinforcement assembly 110 illustrated in FIGS. 8 and 9 is similar to the reinforcement assembly 10 illustrated in FIGS. 1, 2, 3, 4, 5, 6, and 7 and described above, except as detailed below. In the illustrated embodiment, the reinforcement assembly 110 comprises a plate 112, a plurality of connectors 114, and a plurality of elongate members 116.

In the illustrated embodiment, the plate body 126 defines a first plurality of projections 160 and a second plurality of projections 162. Each projection of the first plurality of projections 160 extends from the plate top surface 120 and away from the plate bottom surface 122. Each projection of the second plurality of projections 162 extends from the plate bottom surface 122 and away from the plate top surface 120. Each projection of the first plurality of projections 160 and the second plurality of projections 162 provides a mechanism to enhance load transfer and adhesion between the plate 112 and concrete when the reinforcement assembly 110 is disposed within a concrete foundation. The inclusion of a first plurality of projections 160 and a second plurality of projections 162 is considered advantageous in high load applications.

While the plate 112 has been illustrated as including a first plurality of projections 160 and a second plurality of projections 162, a plate can include any suitable number of projections and selection of a suitable number of projections to include on a plate can be based on various considerations, including the load intended to be supported by a foundation that includes a reinforcement assembly. Example numbers of projections considered suitable to include on a plate top surface, a plate bottom surface, a plate outer surface, and/or a plate inner surface include one, at least one, two, a plurality, three, four, five, more than five, more than ten, more than twenty, and any other number considered suitable for a particular embodiment.

While the plate body 126 has been illustrated as forming each projection of the first plurality of projections 160 and each projection of the second plurality of projections 162, a projection included on a plate can alternatively comprise a separate component attached to the plate using any suitable technique or method of attachment. Selection of a suitable technique or method of attachment to attach a projection to a plate can be based on various considerations, including the material(s) that form the projection and/or plate. Example techniques and methods of attachment considered suitable to attach a projection to a plate include threaded connections, friction fit connections, welding, arc welding, metal inert gas welding (MIG), tungsten inert gas welding (TIG), friction welding, and any other technique or method of attachment considered suitable for a particular embodiment. In embodiments in which a projection is a separate component attached to a plate, the projection can be formed of any suitable material and selection of a suitable material can be based on various considerations, such as the material(s) that form a plate. Example materials considered suitable to form a projection included in a reinforcement assembly include rigid materials, metals, such as steel, stainless steel, tempered steel, carbon steel, galvanized steel, steel that contains manganese, silicon, and/or carbon, alloys, and any other material considered suitable for a particular embodiment. For example, a projection can be formed of a first material and a plate can be formed of a second material. The first material can be the same as, or different than, the second material.

While each projection of the first plurality of projections 160 and each projection of the second plurality of projections 162 has been illustrated as a curved elongate member, a projection can have any suitable structural arrangement. Selection of a suitable structural arrangement for a projection can be based on various considerations, including the intended use of a reinforcement assembly on which a projection is intended to be attached. Example structural configurations considered suitable for a projection include projections that are cylindrical, cuboidal, a cube, hexagonal prisms, rings, curved, curved elongate members, and any other structural arrangement considered suitable for a particular embodiment.

Figure 10:
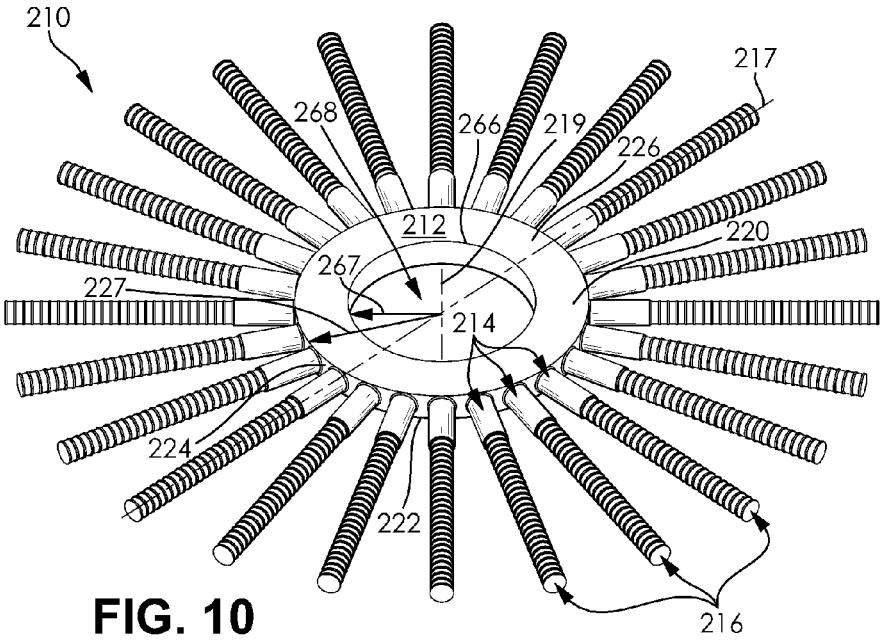
FIG. 10 is a perspective view of another reinforcement assembly.

FIG. 10 illustrates another example embodiment of a reinforcement assembly 210. The reinforcement assembly 210 illustrated in FIG. 10 is similar to the reinforcement assembly 10 illustrated in FIGS. 1, 2, 3, 4, 5, 6 and 7 and described above, except as detailed below. In the illustrated embodiment, the reinforcement assembly 210 comprises a plate 212, a plurality of connectors 214, and a plurality of elongate members 216.

In the illustrated embodiment, the plate 212 comprises a ring member and the plate body 226 defines a plate inner surface 266 and a plate passageway 268 that extends from an opening on the plate top surface 220 to an opening on the plate bottom surface 222. Each of the plate outer surface 224 and the plate inner surface 266 has a circular cross section taken along a plane that contains the plate lengthwise axis 217 and is orthogonal to the plate center axis 219. The plate inner surface 266 is disposed from the plate center axis 219 by a distance 267. The distance 267 the plate inner surface 266 is disposed from the plate center axis 219 is less than the distance 227 the plate outer surface 224 is disposed from the plate center axis 219. It is considered advantageous to utilize a plate that comprises a ring member (e.g., the plate body defines a passageway that extends through the plate) in low load applications and in applications in which it is desired to utilize a plate with less total weight relative to a plate that does not define a passageway through the plate.

While the plate 212 has been illustrated as having a plate outer surface 224 and a plate inner surface 266 having a circular cross section as taken along a plane that contains the plate lengthwise axis 217, the plate outer surface and the plate inner surface can have any suitable cross sectional configuration. Selection of a suitable cross sectional configuration for a plate outer surface and/or a plate inner surface can be based on various considerations, including the intended use of a reinforcement assembly of which the plate is a component. Example cross sectional configurations considered suitable for a plate outer surface and/or a plate inner surface, as taken along a plane that contains the plate lengthwise axis, include circular, oval, rectangular, hexagonal, and any other cross sectional configuration considered suitable for a particular embodiment.

Figure 11:
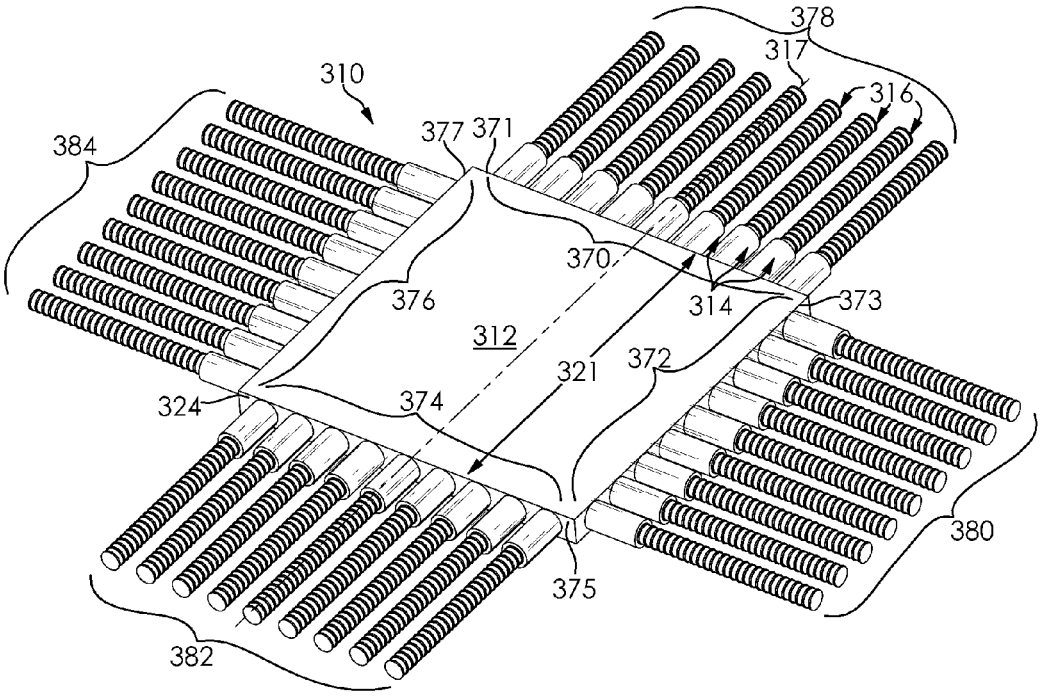
FIG. 11 is a perspective view of another reinforcement assembly.

FIG. 11 illustrates another example embodiment of a reinforcement assembly 310. The reinforcement assembly 310 illustrated in FIG. 11 is similar to the reinforcement assembly 10 illustrated in FIGS. 1, 2, 3, 4, 5, 6 and 7 and described above, except as detailed below. In the illustrated embodiment, the reinforcement assembly 310 comprises a plate 312, a plurality of connectors 314, and a plurality of elongate members 316.

In the illustrated embodiment, the plate 312 comprises a cuboidal member. A first set of connectors 370 of the plurality of connectors 314 is disposed on a first side 371 of the plate outer surface 324. A second set of connectors 372 of the plurality of connectors 314 is disposed on a second side 373 of the plate outer surface 324. A third set of connectors 374 of the plurality of connectors 314 is disposed on a third side 375 of the plate outer surface 324. A fourth set of connectors 376 of the plurality of connectors 314 is disposed on a fourth side 377 of the plate outer surface 324. Each elongate member in a first set of elongate members 378 of the plurality of elongate members 316 is attached to a connector in the first set of connectors 370 of the plurality of connectors 314. Each elongate member of a second set of elongate members 380 of the plurality of elongate members 316 is attached to a connector of the second set of connectors 372 of the plurality of connectors 314. Each elongate member of a third set of elongate members 382 of the plurality of elongate members 316 is attached to a connector of the third set of connectors 374 of the plurality of connectors 314. Each elongate member of a fourth set of elongate members 384 of the plurality of elongate members 316 is attached to a connector of the fourth set of connectors 376 of the plurality of connectors 314.

Each connector of the first set of connectors 370 and each elongate member of the first set of elongate members 378 extends from the first side 371 and away from the third side 375 and is disposed on an axis that is parallel to the plate lengthwise axis 317. Each connector of the second set of connectors 372 and each elongate member of the second set of elongate members 380 extends from the second side 373 and away from the fourth side 377 and is disposed on an axis that is orthogonal to the plate lengthwise axis 317. Each connector of the third set of connectors 374 and each elongate member of the third set of elongate members 382 extends from the third side 375 and away from the first side 371 and is disposed on an axis that is parallel to the plate lengthwise axis 317. Each connector of the fourth set of connectors 376 and each elongate member of the fourth set of elongate members 384 extends from the fourth side 377 and away from the second side 373 and is disposed on an axis that is orthogonal to the lengthwise axis 317 of the plate 312.

Figure 12:
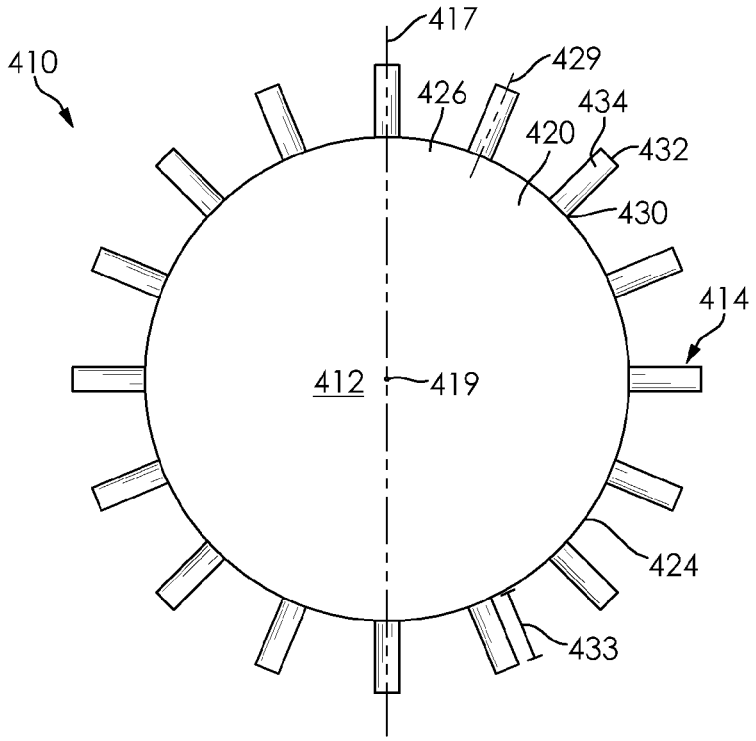
FIG. 12 is a top view of an example embodiment of a reinforcement fixture.
Figure 13:
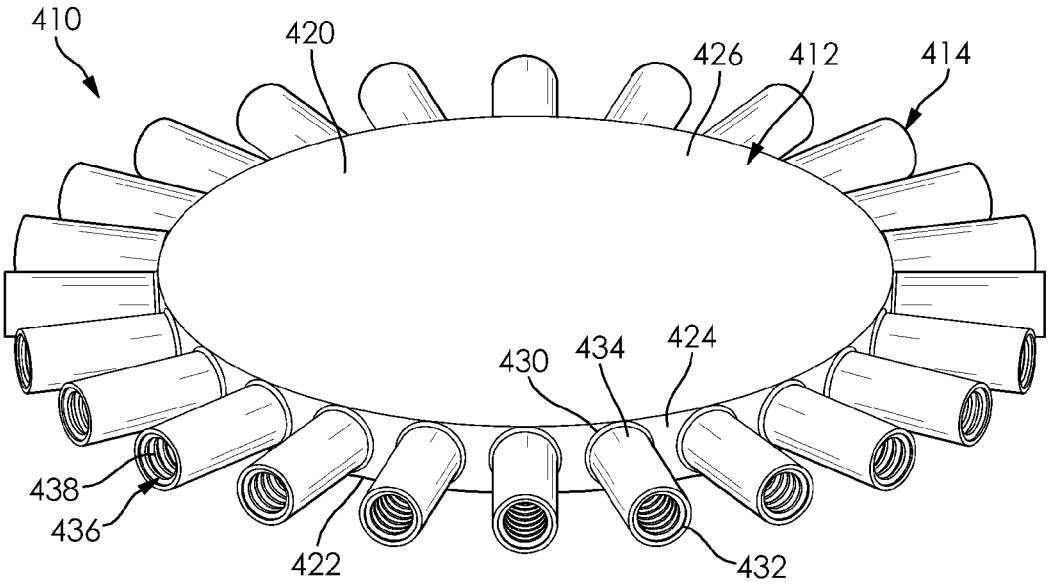
FIG. 13 is a perspective view of the reinforcement fixture illustrated in FIG. 12.
Figure 14:
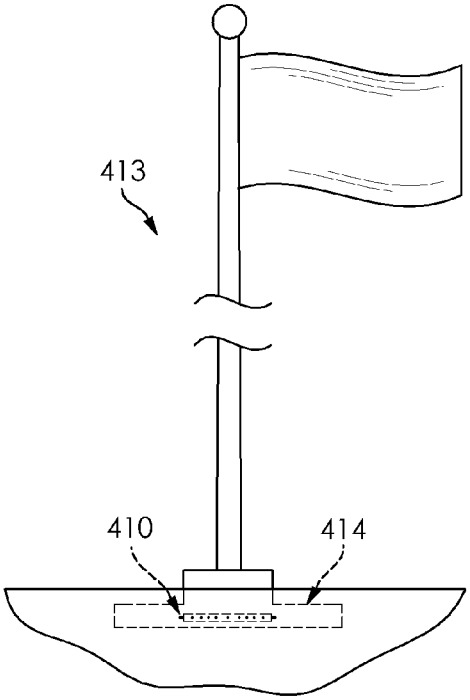
FIG. 14 is an elevation view of a flagpole that is disposed on a foundation that includes an example embodiment of a reinforcement fixture.

FIGS. 12, 13, and 14 illustrate an example embodiment of a reinforcement fixture 410 that comprises a plate 412 and a plurality of connectors 414. FIG. 14 illustrates the reinforcement fixture 410 disposed within a foundation 411 that supports a flagpole 413.

In the illustrated embodiment, the reinforcement fixture 410 is similar to the reinforcement assembly 10 illustrated in FIGS. 1, 2, 3, 4, 5, 6 and 7 and described above, except that the reinforcement fixture 410 does not include a plurality of elongate members (e.g., elongate members 16). In the illustrated embodiment, the reinforcement fixture 410 is sized and configured to be disposed within a foundation 411 that supports a flagpole 413.

The plate 412 has a plate lengthwise axis 417, a plate center axis 419, a plate top surface 420, a plate bottom surface 422, a plate outer surface 424, and a plate body 426. The plate lengthwise axis 417 is disposed orthogonal to the plate center axis 419 and passes through the plate outer surface 424. The plate outer surface 424 extends from the plate top surface 420 to the plate bottom surface 422.

In the illustrated embodiment, each connector of the plurality of connectors 414 has a connector lengthwise axis 429, as shown in FIG. 12, a connector first end 430, a connector second end 432, and a connector body 434 that defines a recess 436 and internal threads 438. The recess 436 extends into the connector body 434 from the connector second end 432 and toward the connector first end 430. The internal threads 438 are defined within the recess 436 and extend from the connector second end 432 toward the connector first end 430. The recess 436 and the internal threads 438 are sized and configured to mate with the external threads defined by an elongate member if an elongate member is intended to be attached to the reinforcement fixture 410. Alternatively, each connector of the plurality of connectors, or one or more of the connectors of the plurality of connectors, can define a recess that is sized and configured to receive another device, component, or substance (e.g., concrete).

In the illustrated embodiment, the connector first end 430 of each connector of the plurality of connectors 414 is attached to the plate outer surface 424 by welding each connector of the plurality of connectors 414 to the plate 412.

However, alternative techniques or methods of attachment can be used to attach a connector to a plate, such as those described herein. Each connector of the plurality of connectors 414 extends from the connector first end 430 and away from the plate center axis 419 such that it extends radially outward from the plate outer surface 424. The connector first end 430 and the connector second end 432 of each connector of the plurality of connectors 414 is disposed on a plane that contains the plate lengthwise axis 417 and that is disposed orthogonally to the plate center axis 419. In the illustrated embodiment, the entire connector length 433 of each connector of the plurality of connectors 414 is disposed on a plane that contains the plate lengthwise axis 417 and is disposed orthogonal to the plate center axis 419 (e.g., the connector lengthwise axis 429 of each connector of the plurality of connectors 414 is disposed on the plane). However, alternative configurations between each connector of a plurality of connectors and a plate can be utilized, such as those described herein.

While the reinforcement fixture 410 has been illustrated as sized and configured to be disposed within a foundation 411 that supports a flagpole 413, a reinforcement fixture can be sized and configured to support any suitable structure disposed on a foundation within which one or more reinforcement fixtures are disposed. Example structures considered suitable to support using a foundation that includes one or more reinforcement fixtures include towers, wind turbines, smokestacks, flagpoles, and any other structure considered suitable for a particular embodiment.

While the reinforcement fixture has been illustrated as being similar to the reinforcement assembly 10 illustrated in FIGS. 1, 2, 3, 4, 5, 6 and 7, a reinforcement fixture can have any suitable shape, size, and configuration. Selection of a suitable shape, size, and configuration for a reinforcement fixture can be based on various considerations, including the intended use of the reinforcement fixture. Example sizes, shapes, and configurations considered suitable for a reinforcement fixture include reinforcement fixtures that include a plate, such as plate 12, plate 112, plate 212, plate 312, reinforcement fixtures that include a plurality of connectors attached to a plate, such as the plurality of connectors 14, the plurality of connectors 114, the plurality of connectors 214, the plurality of connectors 314, reinforcement fixtures that include a plate 12 and a plurality of connectors 14 attached to the plate 12, as described herein, reinforcement fixtures that include a plate 112 and a plurality of connectors 114 attached to the plate 112, as described herein, reinforcement fixtures that include a plate 212 and a plurality of connectors 214 attached to the plate 214, as described herein, reinforcement fixtures that include a plate 312 and a plurality of connectors 314 attached to the plate 312, as described herein, combinations of the plates, connectors, and the techniques and methods of attachment between a plate and a connector, as described herein, and any other size, shape, and configuration considered suitable for a particular embodiment.

While a single reinforcement fixture 410 has been illustrated as included in a foundation 411 that supports a flagpole 413 in FIG. 14, any suitable number of reinforcement fixtures can be disposed within a foundation that supports a structure. Selection of a suitable number of reinforcement fixtures to include in a foundation can be based on various considerations, including the size of the load intended to be support by the foundation that includes one or more reinforcement fixtures. Example numbers of reinforcement fixtures to include in a foundation include one, at least one, two, a plurality, three, four, five, more than five, and any other number considered suitable for a particular embodiment.

When multiple reinforcement fixtures are include in a foundation that supports a structure, the reinforcement fixtures can be arranged in any suitable configuration. Selection of a suitable arrangement to position multiple reinforcement fixtures can be based on various considerations, including the size, shape, and weight of the structure intended to be supported by a foundation that includes the reinforcement fixtures. Example arrangements for multiple reinforcement fixtures included in a foundation include arrangements that position a first reinforcement fixture above a second reinforcement fixture such that the plate center axis of the first reinforcement fixture is coaxial with the plate center axis of the second reinforcement fixture, arrangements that position a first reinforcement fixture near a second reinforcement fixture such that the plate center axis of the first reinforcement fixture is offset from (e.g., not coaxial with) the plate center axis of the second reinforcement fixture, arrangements that position a first reinforcement fixture adjacent to a second reinforcement fixture such that the plate lengthwise axis of the first reinforcement fixture is coaxial with the lengthwise axis of the second reinforcement fixture, arrangements that position a first reinforcement fixture near a second reinforcement fixture such that the plate lengthwise axis of the first reinforcement fixture is offset from (e.g., not coaxial with) the lengthwise axis of the second reinforcement fixture, and any other arrangement considered suitable for a particular embodiment. Optionally, in embodiments in which multiple reinforcement fixtures are disposed within a foundation that supports a structure a first reinforcement fixture can be attached to a second reinforcement fixture using any suitable structure and technique or method of attachment, such as those described herein. Examples of suitable structures that can be used to attach a first reinforcement fixture to a second reinforcement fixture include elongate members, such as those described herein.

Figure 15:
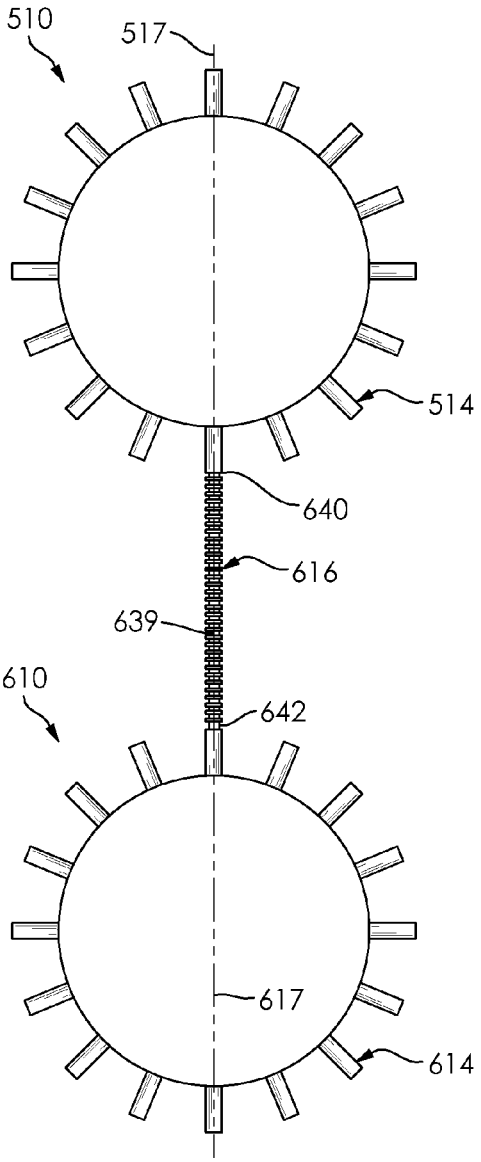
FIG. 15 is a top view of an example embodiment of a first reinforcement fixture that is attached to a second reinforcement fixture using an elongate member.

FIG. 15 illustrates an example embodiment of a first reinforcement fixture 510 that is attached to a second reinforcement fixture 610 using an elongate member 616. Each of the first reinforcement fixture 510 and the second reinforcement fixture 610 is similar to the reinforcement fixture 410 illustrated in FIGS. 12, 13, and 14 and described above, except as detailed below, and the elongate member 616 is similar to an elongate member of the plurality of elongate members 16 illustrated in FIGS. 1, 2, 3, 4, 5, 6, and 7 and described above, except as detailed below.

In the illustrated embodiment, the first reinforcement fixture 510 is attached to the second reinforcement fixture 610 using the elongate member 616. The elongate member first end 640 is attached to the first reinforcement fixture 510 via a connector of the plurality of connectors 514. The elongate member second end 642 is attached to the second reinforcement fixture 610 via a connector of the plurality of connectors 614. In the illustrated embodiment, the elongate member 616 is straight such that the first reinforcement fixture 510 is disposed adjacent to the second reinforcement fixture 610. In the illustrated embodiment, the plate lengthwise axis 517 of the first reinforcement fixture 510 is coaxial with the plate lengthwise axis 617 of the second reinforcement fixture 610 and the elongate member lengthwise axis 639.

While the elongate member 616 has been illustrated as straight, an elongate member, or any other component attaching a first reinforcement fixture to a second reinforcement fixture, can have any suitable structural configuration.

Selection of a suitable structural configuration for an elongate member, or any other component, that is attached to a first reinforcement fixture and to a second reinforcement fixture include straight, such that it defines a first bend, or more than one bend, and the first reinforcement fixture is offset from a second reinforcement fixture, such that it defines a first bend, or more than one bend, and the first reinforcement fixture is aligned with a second reinforcement fixture (e.g., plate center axis of the first reinforcement fixture is coaxial with the plate center axis of the second reinforcement fixture, plate lengthwise axis of the first reinforcement fixture is coaxial with the plate lengthwise axis of the second reinforcement fixture), and any other structural configuration considered suitable for a particular embodiment.

Methods of constructing a reinforcement assembly and methods of constructing a reinforcement fixture are described herein. While the methods described herein are shown an described as series of acts, it is to be understood and appreciated that the methods are not limited by the order of acts described and illustrated, as some acts may in accordance with these methods, be omitted, be repeated, or occur in different orders and/or concurrently with other acts described herein.

Figure 16:
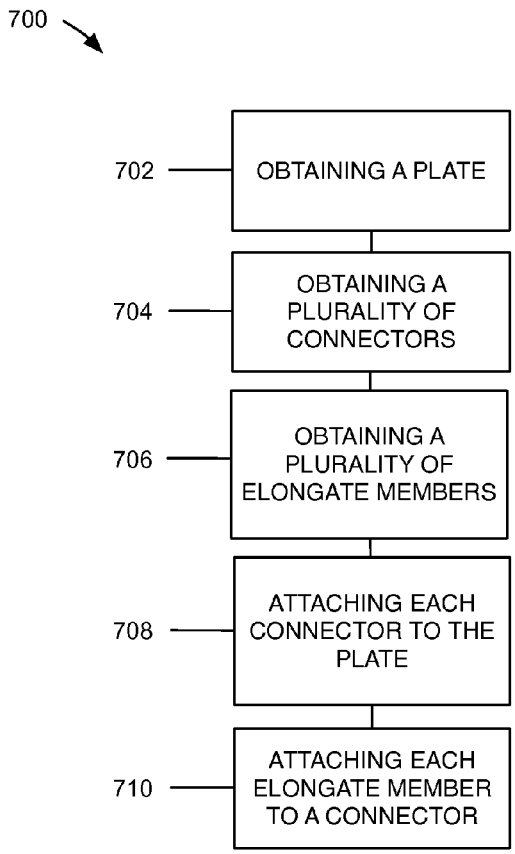
FIG. 16 is a schematic illustration of an example method of constructing a reinforcement assembly.

FIG. 16 is a schematic illustration of an example method 700 of constructing a reinforcement assembly.

A step 702 comprises obtaining a plate that has a plate lengthwise axis, a plate center axis, a plate top surface, a plate bottom surface, and a plate outer surface that extends from the plate top surface to the plate bottom surface. The plate lengthwise axis is disposed orthogonal to the plate center axis. Another step 704 comprises obtaining a plurality of connectors. Each connector of the plurality of connectors has a connector first end, a connector second end, and a connector length that extends from the connector first end to the connector second end. Another step 706 comprises obtaining a plurality of elongate members. Each elongate member of the plurality of elongate members has an elongate member first end, an elongate member second end, and an elongate member length that extends from the elongate member first end to the elongate member second end. Another step 708 comprises attaching each connector of the plurality of connectors to the plate outer surface such that each of the connector first end, the connector second end, and the entire connector length of each connector of the plurality of connectors is disposed on a plane that contains the plate lengthwise axis and is disposed orthogonal to the plate center axis. Another step 710 comprises attaching each elongate member of the plurality of elongate members to a connector of the plurality of connectors such that each of the elongate member first end, the elongate member second end, and the entire elongate member length of each elongate member of the plurality of elongate members is disposed on the plane that contains the plate lengthwise axis and is disposed orthogonal to the plate center axis.

Step 702 can be accomplished by obtaining any suitable plate, formed of any suitable material, and having any suitable structural configuration. Selection of a suitable plate to utilize to complete a method of constructing a reinforcement assembly can be based on various considerations, including the intended use of the reinforcement assembly. Example plates considered suitable to utilize to complete a method of constructing a reinforcement assembly include the plates described herein, such as plate 12, plate 112, plate 212, plate 312, variations of the plates described herein, and any other plate considered suitable for a particular embodiment.

Step 704 can be accomplished by obtaining any suitable connector, formed of any suitable material, and having any suitable structural configuration. Selection of a suitable connector to utilize to complete a method of constructing a reinforcement assembly can be based on various considerations, including the structural configuration of a plate to which the plurality of connectors is intended to be attached. Example connectors considered suitable to utilize to complete a method of constructing a reinforcement assembly include the connectors described herein, such as connector 14, connector 114, connector 214, connector 314, variations of the connectors described herein, and any other connector considered suitable for a particular embodiment.

Step 706 can be accomplished by obtaining any suitable elongate member, formed of any suitable material, and having any suitable structural configuration. Selection of a suitable elongate member to utilize to complete a method of constructing a reinforcement assembly can be based on various considerations, including the structural configuration of a connector to which an elongate member of the plurality of elongate members is intended to be attached. Example elongate members considered suitable to utilize to complete a method of constructing a reinforcement assembly include the elongate members described herein, such as elongate member 16, elongate member 116, elongate member 216, elongate member 316, variations of the elongate members described herein, and any other elongate member considered suitable for a particular embodiment.

Step 708 can be accomplished using any suitable technique or method of attachment and selection of a suitable technique or method of attachment to attach each connector of the plurality of connectors to a plate can be can based on various considerations, such as the material(s) that form a connector and/or base. Example techniques or methods of attachment considered suitable to attach a connector to a plate include using threaded connections, friction fit connections, welding, arc welding, metal inert gas welding (MIG), tungsten inert gas welding (TIG), friction welding, and any other technique or method of attachment considered suitable for a particular embodiment.

While step 708 has been described as attaching each connector of the plurality of connectors to the plate such that each of the connector first end, the connector second end, and the entire connector length of each connector of the plurality of connectors is disposed on a plane that contains the plate lengthwise axis and is disposed orthogonal to the plate center axis, a connector can be attached to a plate in any suitable configuration. Selection of a suitable configuration to attach a connector to a plate can be based on various considerations, such as the intended use of the reinforcement assembly of which the connector is a component. Example configurations considered suitable to attach a connector to a plate include configurations that position the connector first end, the connector second end, a portion of the connector length, and/or the entire connector length on a plane that contains the plate lengthwise axis and that is disposed at an angle to (e.g., orthogonal) to the plate center axis.

While step 708 has been described as attaching each connector of the plurality of connectors to the plate outer surface, an alternative step that can be completed comprises attaching each connector of the plurality of connectors to the plate. This step can be accomplished by attaching each connector of a plurality of connectors to any suitable surface of a plate such as the plate top surface, the plate bottom surface, the plate outer surface, and/or the plate inner surface.

Step 710 can be accomplished using any suitable technique or method of attachment and selection of a suitable technique or method of attachment to attach each elongate member of a plurality of elongate members to a connector of the plurality of connectors can be can based on various considerations, such as the structural configuration and/or the material(s) that form a connector. Example techniques or methods of attachment considered suitable to attach an elongate member to a connector include using threaded connections, using one or more set screws, using a compressible connector that can be compressed onto an elongate member to accomplish attachment of an elongate member to the connector, friction fit connections, welding, arc welding, metal inert gas welding (MIG), tungsten inert gas welding (TIG), friction welding, and any other technique or method of attachment considered suitable for a particular embodiment.

While step 710 has been described as attaching each elongate member of the plurality of elongate members to a connector of a plurality of connectors such that each of the elongate member first end, the elongate member second end, and the entire elongate member length of each elongate member of the plurality of elongate members is disposed on a plane that contains the plate lengthwise axis and is disposed orthogonal to the plate center axis, an elongate member can be attached to a connector in any suitable configuration. Selection of a suitable configuration to attach an elongate member to a connector can be based on various considerations, such as the intended use of the reinforcement assembly of which the elongate member is a component. Example configurations considered suitable to attach an elongate member to a connector include configurations that position the elongate member first end, the elongate member second end, a portion of the elongate member length, and/or the entire elongate member length on a plane that contains the plate lengthwise axis and that is disposed at an angle to (e.g., orthogonal) the plate center axis.

In embodiments in which step 708 has been replaced with the alternative step that comprises attaching each connector of the plurality of connectors to the plate, step 710 can alternatively comprise attaching each elongate member of a plurality of elongate members to a connector of the plurality of connectors. This step can be accomplished by attaching each elongate member of a plurality of elongate members to a connector that is attached to any suitable surface of a plate such as the plate top surface, the plate bottom surface, the plate outer surface, and/or the plate inner surface.

Figure 17:
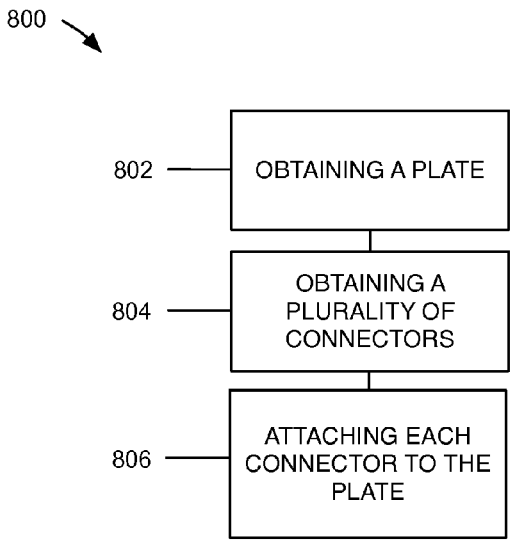
FIG. 17 is a schematic illustration of an example method of constructing a reinforcement fixture.

FIG. 17 is a schematic illustration of an example method 800 of constructing a reinforcement fixture.

A step 802 comprises obtaining a plate that has a plate lengthwise axis, a plate center axis, a plate top surface, a plate bottom surface, and a plate outer surface that extends from the plate top surface to the plate bottom surface. The plate lengthwise axis is disposed orthogonal to the plate center axis. Another step 804 comprises obtaining a plurality of connectors. Each connector of the plurality of connectors has a connector first end, a connector second end, and a connector length that extends from the connector first end to the connector second end. Another step 806 comprises attaching each connector of the plurality of connectors to the plate outer surface such that each of the connector first end, the connector second end, and the entire connector length of each connector of the plurality of connectors is disposed on a plane that contains the plate lengthwise axis and is disposed orthogonal to the plate center axis.

Step 802 can be accomplished by obtaining any suitable plate, formed of any suitable material, and having any suitable structural configuration. Selection of a suitable plate to utilize to complete a method of constructing a reinforcement assembly can be based on various considerations, including the intended use of the reinforcement assembly. Example plates considered suitable to utilize to complete a method of constructing a reinforcement assembly include the plates described herein, such as plate 12, plate 112, plate 212, plate 312, variations of the plates described herein, and any other plate considered suitable for a particular embodiment.

Step 804 can be accomplished by obtaining any suitable connector, formed of any suitable material, and having any suitable structural configuration. Selection of a suitable connector to utilize to complete a method of constructing a reinforcement assembly can be based on various considerations, including the structural configuration of a plate to which the plurality of connectors is intended to be attached. Example connectors considered suitable to utilize to complete a method of constructing a reinforcement assembly include the connectors described herein, such as connector 14, connector 114, connector 214, connector 314, variations of the connectors described herein, and any other connector considered suitable for a particular embodiment.

Step 806 can be accomplished using any suitable technique or method of attachment and selection of a suitable technique or method of attachment to attach each connector of the plurality of connectors to a plate can be can based on various considerations, such as the material(s) that form a connector and/or base. Example techniques or methods of attachment considered suitable to attach a connector to a plate include using threaded connections, friction fit connections, welding, arc welding, metal inert gas welding (MIG), tungsten inert gas welding (TIG), friction welding, and any other technique or method of attachment considered suitable for a particular embodiment.

While step 806 has been described as attaching each connector of the plurality of connectors to the plate such that each of the connector first end, the connector second end, and the entire connector length of each connector of the plurality of connectors is disposed on a plane that contains the plate lengthwise axis and is disposed orthogonal to the plate center axis, a connector can be attached to a plate in any suitable configuration. Selection of a suitable configuration to attach a connector to a plate can be based on various considerations, such as the intended use of the reinforcement assembly of which the connector is a component. Example configurations considered suitable to attach a connector to a plate include configurations that position the connector first end, the connector second end, a portion of the connector length, and/or the entire connector length on a plane that contains the plate lengthwise axis and that is disposed at an angle to (e.g., orthogonal) to the plate center axis.

While step 806 has been described as attaching each connector of the plurality of connectors to the plate outer surface, an alternative step that can be completed comprises attaching each connector of the plurality of connectors to the plate. This step can be accomplished by attaching each connector of a plurality of connectors to any suitable surface of a plate such as the plate top surface, the plate bottom surface, the plate outer surface, and/or the plate inner surface.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A reinforcement assembly comprising:

a plate having a plate lengthwise axis, a plate center axis, a plate top surface, a plate bottom surface, and a plate outer surface extending from the plate top surface to the plate bottom surface, the plate top surface having a plate diameter, the plate outer surface having a plate length that is less than the plate diameter, the plate lengthwise axis passing through the plate outer surface and disposed orthogonal to the plate center axis, the plate having a continuous surface along the plate diameter;

a plurality of connectors, each connector of the plurality of connectors having a connector first end and a connector second end, the connector first end of each connector of the plurality of connectors attached to the plate outer surface, the connector first end and the connector second end of each connector of the plurality of connectors disposed on a first plane that contains the plate lengthwise axis and that is disposed orthogonally to the plate center axis; and a plurality of elongate members, each elongate member of the plurality of elongate members having an elongate member first end and an elongate member second end, the elongate member first end of each elongate member of the plurality of elongate member attached to a connector of the plurality of connectors, the elongate member first end and the elongate member second end of each elongate member of the plurality of elongate members disposed on the first plane.

2. The reinforcement assembly of claim 1, wherein each connector of the plurality of connectors has a connector length that extends from the connector first end to the connector second end; and wherein the entire connector length of each connector of the plurality of connectors is disposed on the first plane.

3. The reinforcement assembly of claim 1, wherein each elongate member of the plurality of elongate members has an elongate member length that extends from the elongate member first end to the elongate member second end; and wherein the entire elongate member length of each elongate member of the plurality of elongate members is disposed on the first plane.

4. The reinforcement assembly of claim 1, wherein each elongate member of the plurality of elongate members has an elongate member length that extends from the elongate member first end to the elongate member second end; and wherein the elongate member length of each elongate member of the plurality of elongate members is greater than the plate diameter.

5. The reinforcement assembly of claim 1, wherein the plate comprises a cylindrical member.

6. The reinforcement assembly of claim 1, wherein the plate has a plate body that defines a passageway that extends through the plate and from the plate top surface to the plate bottom surface.

7. A reinforcement assembly comprising:

a plate having a plate lengthwise axis, a plate center axis, a plate top surface, a plate bottom surface, and a plate outer surface extending from the plate top surface to the plate bottom surface, the plate top surface having a plate diameter, the plate outer surface having a plate length that is less than the plate diameter, the plate lengthwise axis passing through the plate outer surface and disposed orthogonal to the plate center axis;

a plurality of connectors, each connector of the plurality of connectors having a connector first end and a connector second end, the connector first end of each connector of the plurality of connectors attached to the plate outer surface, the connector first end and the connector second end of each connector of the plurality of connectors disposed on a first plane that contains the plate lengthwise axis and that is disposed orthogonally to the plate center axis; and a plurality of elongate members, each elongate member of the plurality of elongate members having an elongate member first end and an elongate member second end, the elongate member first end of each elongate member of the plurality of elongate member attached to a connector of the plurality of connectors, the elongate member first end and the elongate member second end of each elongate member of the plurality of elongate members disposed on the first plane;

wherein the plate has a first plurality of projections extending from the plate top surface and away from the plate bottom surface.

8. The reinforcement assembly of claim 7, wherein each projection of the first plurality of projections is a separate component that is attached to the plate.

9. A reinforcement assembly comprising:

a plate having a plate lengthwise axis, a plate center axis, a plate top surface, a plate bottom surface, and a plate outer surface extending from the plate top surface to the plate bottom surface, the plate top surface having a plate diameter, the plate outer surface having a plate length that is less than the plate diameter, the plate lengthwise axis passing through the plate outer surface and disposed orthogonal to the plate center axis;

a plurality of connectors, each connector of the plurality of connectors having a connector first end and a connector second end, the connector first end of each connector of the plurality of connectors attached to the plate outer surface, the connector first end and the connector second end of each connector of the plurality of connectors disposed on a first plane that contains the plate lengthwise axis and that is disposed orthogonally to the plate center axis; and a plurality of elongate members, each elongate member of the plurality of elongate members having an elongate member first end and an elongate member second end, the elongate member first end of each elongate member of the plurality of elongate member attached to a connector of the plurality of connectors, the elongate member first end and the elongate member second end of each elongate member of the plurality of elongate members disposed on the first plane;

wherein the plate has a second plurality of projections extending from the plate bottom surface and away from the plate top surface.

10. The reinforcement assembly of claim 9, wherein each projection of the second plurality of projections is a separate component attached to the plate.

11. The reinforcement assembly of claim 1, wherein the connector first end of each connector of the plurality of connectors is welded to the plate outer surface.

12. The reinforcement assembly of claim 1, wherein the plate length has a midpoint; and wherein the first plane is disposed at the midpoint of the plate length.

13. The reinforcement assembly of claim 1, wherein each elongate member of the plurality of elongate members is a steel reinforcing rod.

* * * * *